US007200942B2

(12) United States Patent
Richard

(10) Patent No.: US 7,200,942 B2
(45) Date of Patent: Apr. 10, 2007

(54) SAFETY RAZOR WITH PIVOT POINT SHIFT FROM CENTER TO GUARD-BAR UNDER APPLIED LOAD

(75) Inventor: Paul Richard, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 137 days.

(21) Appl. No.: 09/820,378

(22) Filed: Mar. 28, 2001

(65) Prior Publication Data

US 2002/0138992 A1 Oct. 3, 2002

(51) Int. Cl.
*B26B 21/00* (2006.01)

(52) U.S. Cl. ..... 30/526; 30/527; 30/531

(58) Field of Classification Search ..... 30/527, 30/529, 532, 530, 531, 533, 526
See application file for complete search history.

(56) References Cited

U.S. PATENT DOCUMENTS

| | | | | | |
|---|---|---|---|---|---|
| 2,125,135 | A * | 7/1938 | Trippe | 30/527 |
| 2,710,447 | A * | 6/1955 | Borden | 30/58 |
| 3,935,639 | A * | 2/1976 | Terry et al. | 30/47 |
| 4,026,016 | A * | 5/1977 | Nissen | 30/47 |
| 4,083,104 | A | 4/1978 | Nissen | 30/47 |
| 4,094,063 | A | 6/1978 | Trotta | 30/47 |
| 4,152,828 | A * | 5/1979 | Lund | 30/529 |
| 4,198,746 | A | 4/1980 | Trotta | 30/47 |
| 4,253,237 | A | 3/1981 | Jacobson | 30/89 |
| 4,281,456 | A * | 8/1981 | Douglass et al. | 30/89 |
| 4,283,850 | A | 8/1981 | Douglass et al. | 30/47 |
| 4,288,920 | A | 9/1981 | Douglass et al. | 30/47 |
| 4,403,414 | A * | 9/1983 | Kiraly et al. | 30/57 |
| 4,488,357 | A | 12/1984 | Jacobson | 30/57 |
| 4,492,025 | A | 1/1985 | Jacobson | 30/87 |
| 4,514,904 | A | 5/1985 | Bond | 30/87 |
| 4,573,266 | A | 3/1986 | Jacobson | 30/41 |
| 4,587,729 | A | 5/1986 | Jacobson | 30/41 |
| 4,739,553 | A | 4/1988 | Lazarchik | 30/47 |
| 4,756,082 | A | 7/1988 | Apprille, Jr. | 30/89 |
| 4,785,534 | A | 11/1988 | Lazarchik | 30/50 |
| 4,970,784 | A | 11/1990 | Althaus et al. | 30/89 |
| 5,016,352 | A | 5/1991 | Metcalf | 30/85 |
| 5,533,263 | A | 7/1996 | Gilder | 30/87 |
| 5,636,442 | A | 6/1997 | Wain | 30/40 |
| 5,661,907 | A | 9/1997 | Apprille, Jr. | 30/47 |
| 6,112,412 | A * | 9/2000 | Richard | 30/41.5 |
| 6,115,924 | A | 9/2000 | Oldroyd | 30/527 |
| 6,138,361 | A * | 10/2000 | Richard et al. | 30/50 |
| 6,161,288 | A * | 12/2000 | Andrews | 30/50 |
| 6,311,400 | B1 * | 11/2001 | Hawes et al. | 30/527 |
| 6,425,184 | B1 * | 7/2002 | Min | 30/527 |
| 6,442,850 | B1 * | 9/2002 | Coffin | 30/532 |
| 6,615,498 | B1 * | 9/2003 | King et al. | 30/527 |
| 2002/0104223 | A1 * | 8/2002 | Oldroyd | 30/532 |

FOREIGN PATENT DOCUMENTS

GB 2116470 A 9/1983

* cited by examiner

*Primary Examiner*—Timothy V. Eley
*Assistant Examiner*—Omar Flores Sánchez
(74) *Attorney, Agent, or Firm*—Michaud-Duffy Group LLP

(57) ABSTRACT

A safety razor which features a pivot point that shifts from a center point pivot substantially on the shave plane, to a guard-bar pivot substantially on the shave plane, as shaving forces increase to help prevent nicks and cuts, and provide a smooth shave.

20 Claims, 4 Drawing Sheets

SAFETY RAZOR WITH PIVOT POINT SHIFT FROM CENTER TO GUARD-BAR UNDER APPLIED LOAD

BACKGROUND OF THE INVENTION

1. Field of the Invention

The invention relates generally to safety razor shaving systems that include razor blade assemblies for mounting on handles via pivotal connections. More particularly, the invention relates to a safety razor which features a pivot point that shifts from a center point pivot (e.g., at the center blade of a triple blade razor, substantially on the shave plane), to a guard-bar pivot, substantially on the shave plane, as shaving forces increase to help prevent nicks and cuts, and provide a smooth shave.

2. Brief Description of the Prior Art

Safety razors are well known that employ blade units with a plurality of blades defining sharpened edges arranged to pass in succession over a skin surface being shaved.

The invention is applicable to safety razors having blade units in the form of cartridges detachably mounted on a handle for replacement when the blade edges have become dulled; and to disposable safety razors having blade unit cartridges, which are permanently attached to a razor handle.

The aforementioned blade unit cartridges (whether permanently affixed to a handle or in the form of a replaceable cartridge), generally comprise a rectangular molded plastic frame with guard and cap surfaces on the lengthwise extending frame parts. Within the opening of the frame the blades are arranged in tandem with their cutting edges parallel to each other and directed towards the guard surface.

It is well known that the so-called shaving geometry of a blade unit is important in determining the shaving performance of the unit. The shaving geometry defines the position and orientation of the blades in relation to other skin contacting parts, in particular the guard and cap of the blade unit.

Well known razor blade assemblies employ spring biased cam followers on razor handles to interact with cam surfaces on the bottoms of razor blade assemblies so as to bias the assemblies to neutral positions relative to the handles.

During shaving, the cartridge assemblies can pivot forward or rearward from the neutral position relative to the handle, and the blade package can thereby follow the contours of the skin surface during shaving.

Examples of commercially available safety razors that include the aforementioned pivoting feature include the Schick Xtreame III (TM) triple blade convenience razor; the Gillette Sensor Excel (TM) safety razor and Gillette's Mach III (TM) safety razor.

The blade cartridges for both the Schick Xtreame III razor and the Gillette Sensor Excel safety razor, pivot about a center point pivot; and the cartridges may pivot in each direction from a neutral position.

A center pivot balances forces to allow one to shave evenly with all three blades of the aforementioned triple blade razors.

The Gillette Mach III safety razor is an example of a razor that features a guard-bar pivot (pivoting takes place on an axis through the guard-bar as opposed to a center point pivot); with the cartridge being capable of pivotal movement in only one direction from its neutral position.

With a guard-bar pivot one obtains a "safer" shave than with a center pivot arrangement since applied loads (e.g., pressing the razor against the skin) are on the guard-bar and not the blades. The guard-bar also facilities stretching of the skin compared with a center pivot system, thereby promoting a safe close shave.

During shaving the blades of a blade unit are subjected to a combination of drag forces and the load forces mentioned hereinbefore. Drag forces are those directed essentially parallel to the shaving plane, and load forces are those forces directed against the blade by the skin in the direction substantially perpendicular to the shaving plane (as hereinbefore indicated happens when the razor is pressed in toward the face).

Generally speaking it is important to locate the pivot point of a razor as close to the shave plane as possible to minimize the over-turning moment due to drag force.

Additionally, by applying the razor against the skin surface under greater load pressure to seek an improved closeness of shave, it is desirable to on one hand utilize all the blades in the razor as uniformly as possible (e.g., to prevent dulling of a particular blade, to achieve the maximum cutting action in a single stroke, etc.); yet achieve and maintain a safe shave so that increasingly applied loads do not cause nicks and cuts. Generally, as the force of shaving (loading) increases, the likelihood of experiencing a nick or a cut increases.

Stated another way, it is desirable to accommodate varying loads by the user during the shaving process, minimize drag, insure a close shave and at the same time assure a safe shave.

Although the prior art systems referred to hereinabove employ pivot mechanisms to achieve maximum shaving performance and safety (with tradeoffs of course depending on the type of pivot system used), the pivot axis in all the known systems remain substantially the same.

This has the effect, for center point pivot systems, of not taking maximum advantage of the skin stretching and protection features of the guard-bar which limit blade exposure and protect against nicks and cuts; while for guard-bar pivot systems, do not taking maximum advantage of the multiple blades available in light loading situations where receiving nicks and cuts are far less likely (the aforementioned "tradeoffs").

Accordingly, it would be desirable to be able to increase loading on the razor and yet maintain a safe shave in pivoting razor systems by shifting the pivot point from the center to the guard-bar under heavy load.

It would also be desirable to provide a razor, which pivots about the center for an even shave under light loading but pivots about the guard-bar under heavy loading.

It would be desirable to provide a razor, which accommodates varying loads by a user during the shaving process, minimizes drag, insures a close shave and at the same time assures a safe shave.

It would also be desirable to provide a razor which utilizes all the blades in the razor as uniformly as possible to prevent dulling of a particular blade, which achieves the maximum cutting action in a single stroke, etc.; and at the same time achieves and maintains a safe shave so that increasingly applied loads do not cause nicks and cuts.

SUMMARY OF THE INVENTION

It is a general object of the invention to be able to increase loading on a pivot type razor while maintaining a safe shave.

It is a specific object of the invention to accommodate varying loads by a user during the shaving process, minimize drag, insure a close shave and at the same time assure a safe shave.

It is a further object of the invention to be able to utilize all the blades in the razor as uniformly as possible to prevent dulling of a particular blade, to achieve the maximum cutting action in a single stroke, etc.; and at the same time achieve and maintain a safe shave so that increasingly applied loads do not cause nicks and cuts.

It is yet another object of the invention to provide a razor which pivots about the center of the blade assembly under light loading but which pivots about the guard-bar under heavy loading.

In accord with these objects, which will be discussed in detail below, the razor according to the present invention includes a blade assembly (or cartridge), a pivot assembly, and a pivot frame. The blade assembly is pivotally coupled to the pivot assembly and the pivot assembly is pivotally coupled to the pivot frame.

A first biasing member between the blade assembly and the pivot assembly biases the blade assembly to a first position. A second biasing member between the pivot assembly and the pivot frame biases the pivot frame to a neutral position. The first biasing member is preferably stronger than the second biasing member.

When the blade assembly is in the first position, application of loading to the blade assembly will cause the blade assembly and the pivot assembly to pivot about the center line of the blade assembly. Upon the application of additional load, the blade assembly will be moved against the first biasing member and will move to a second position relative to the pivot assembly. When the blade assembly is in the second position, application of loading to the blade assembly will cause the blade assembly and the pivot assembly to pivot about the guard-bar axis of the blade assembly.

According to one embodiment of the invention, the pivot assembly is pivotable in both directions relative to the pivot frame and is free to pivot approximately ±20° from a neutral or rest position.

According to another embodiment of the invention, the pivot assembly is uni-directionally pivotable relative to the pivot frame and is free to pivot approximately 40°.

The pivotal coupling between the blade assembly and the pivot assembly is preferably effected with a pair of bosses on the pivot assembly and a mating pair of pivot pockets or sockets formed in the blade assembly. The bosses are approximately 180° semi-cylindrical and the pockets subtend an angle of approximately 225° thereby allowing the blade assembly to pivot approximately 45° relative to the pivot assembly. The pivotal coupling between the pivot assembly and the pivot frame is preferably accomplished via a pair of shell bearing which include female journals on the pivot assembly, which are engaged by corresponding male journals on the pivot frame. The second biasing member is preferably embodied as a resilient cantilever member, which extends from a position between the male journals and engages a central portion of the pivot assembly.

In the bi-directional embodiment, the resilient cantilever member engages a pair of inverted U-shaped members. In the uni-directional embodiment, the resilient cantilever member has a cam follower, which engages a cam surface on one side of the pivot assembly.

DETAILED DESCRIPTION

Figure 1:
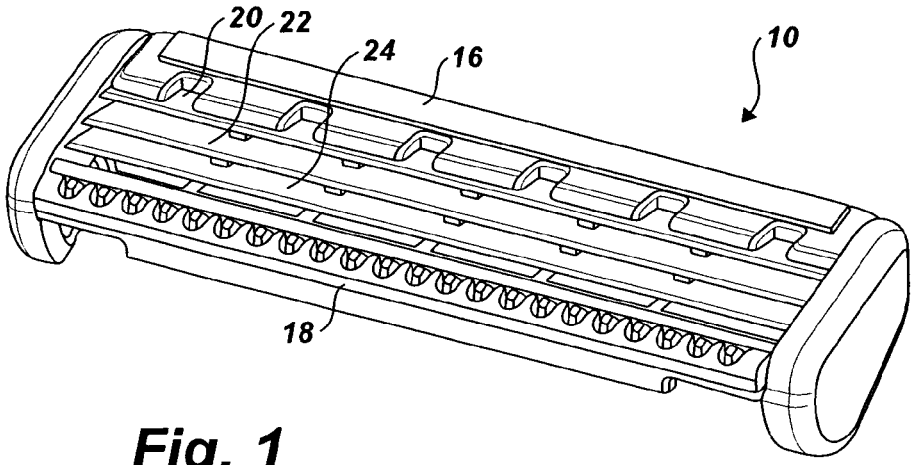
FIG. 1 is a front perspective view of an exemplary triple blade cartridge suitable for use in accordance with the teachings of the invention.
Figure 2:
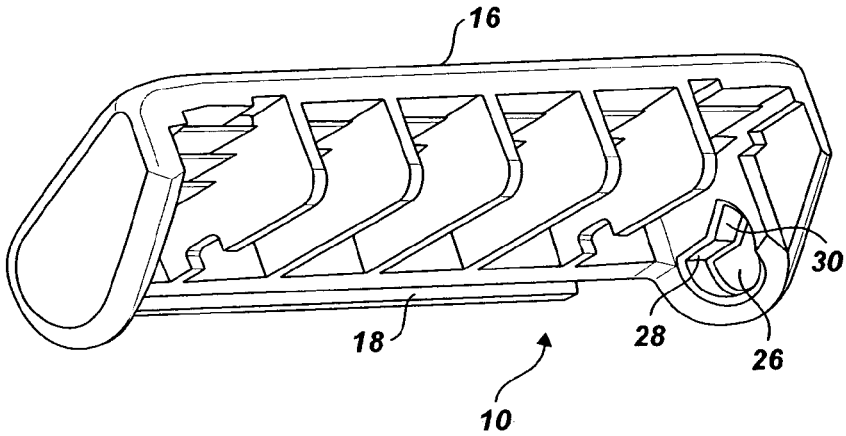
FIG. 2 is a rear perspective view of the exemplary cartridge depicted in FIG. 1
Figure 3:
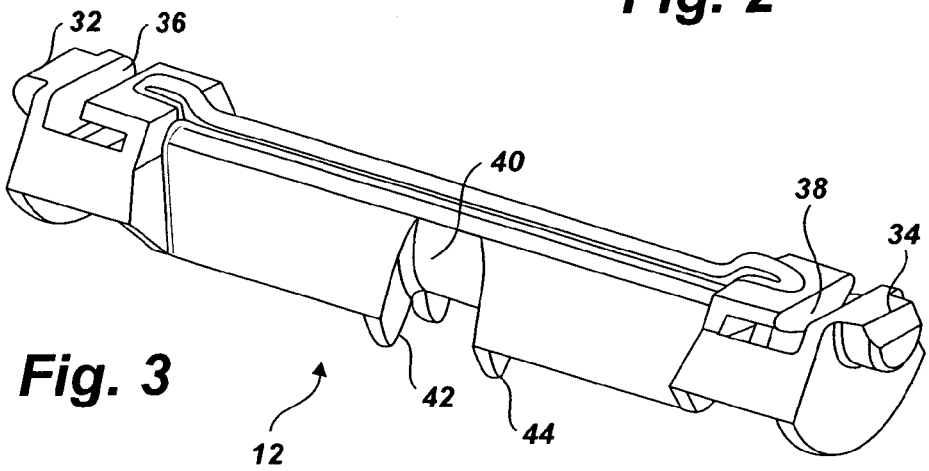
FIG. 3 is a front perspective view of an exemplary pivot that in accord with the teachings of the invention cooperates with the cartridge shown FIGS. 1 & 2.
Figure 4:
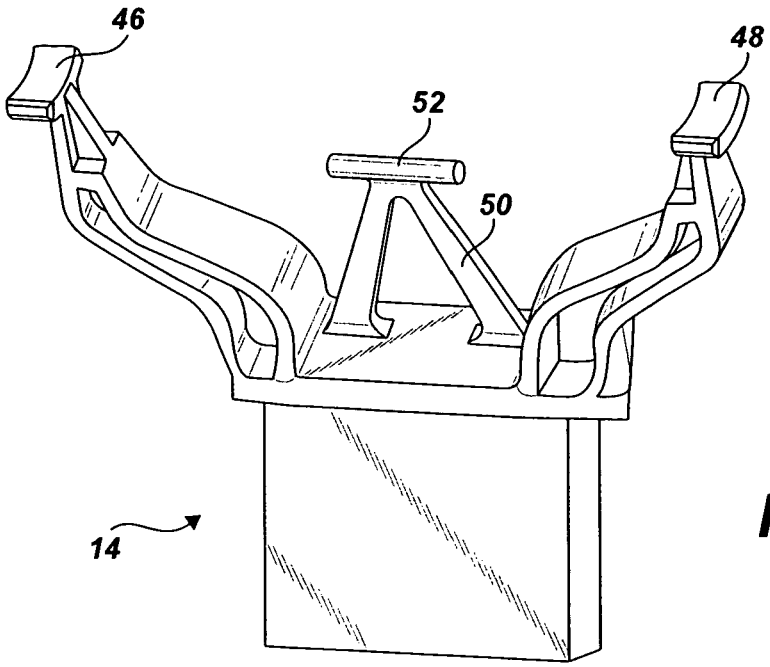
FIG. 4 is a front perspective view of an exemplary bi-directional pivot frame contemplated by the invention.
Figure 5:
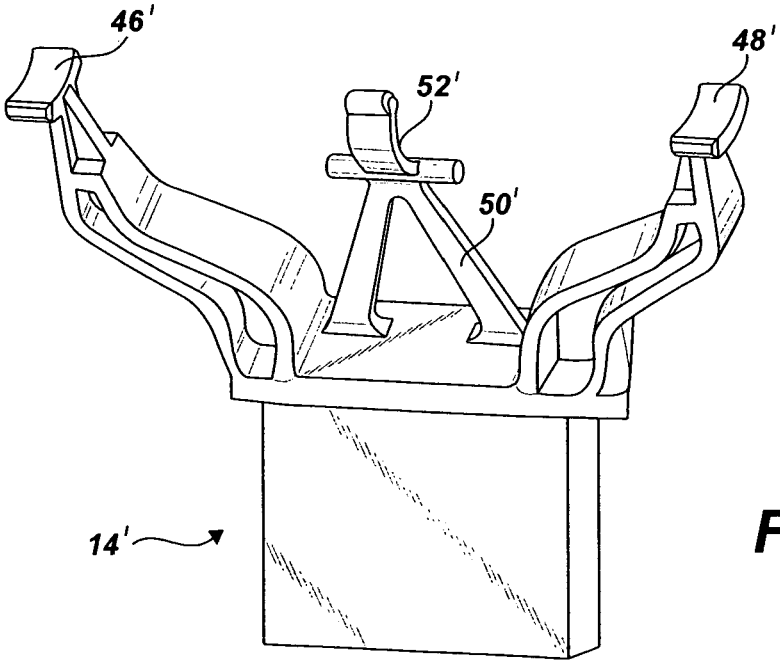
FIG. 5 is a front perspective view of an exemplary unidirectional pivot frame contemplated by the invention.

Turning now to FIGS. 1–5, an exemplary shaving system or razor assembly according to the invention includes a blade assembly (or cartridge) 10, a pivot assembly 12, and a pivot frame 14, 14'. The blade assembly 10 includes a cap 16, a guard-bar 18, and a plurality of blades 20, 22, 24 arranged between the cap and the guard-bar. The lower interior of the blade assembly 10 includes a pair of sockets 26, one of which can be seen in FIG. 2. The sockets have a pair of stops, 28, 30 which are angularly spaced approximately 225° apart.

The pivot assembly 12 has a pair of bosses, 32, 34 which are dimensioned to engage the sockets 26. The bosses are approximately 180° semi-cylindrical bosses. Thus, pivotal movement from stop 28 to stop 30 is approximately 45°. Adjacent the bosses, the pivot assembly has a pair of female journals 36, 38. Centrally, the pivot assembly has a cam surface 40 and a pair of inverted U-shaped members 42, 44.

According to a first embodiment of the invention, components 10 and 12 are mated to each other and to the pivot frame 14. According to a second embodiment of the invention, the components 10 and 12 are mated to each other and to the pivot frame 14'.

The pivot frame 14 has a pair of male journals 46, 48 which are located and dimensioned to engage the female journals 36, 38 of the pivot assembly 12 to form shell rocker bearings which support the pivot assembly 12 to pivot about a virtual axis X fixed relative to the pivot frame 14 and located above the pivot frame 12. The axis X comprises the pivot axis of the shaving system. A cantilevered biasing member 50 is located between the male journals. The biasing member 50 includes an axle 52 which is located and dimensioned to engage the inverted U-shaped members 42, 44 of the pivot assembly 12.

The pivot frame 14' has a pair of male journals 46', 48' which are located and dimensioned to engage the female journals 36, 38 of the pivot assembly 12 (shell rocker bearings). A cantilevered biasing member 50' is located between the male journals. The biasing member 50' includes a cam follower 52', which is located and dimensioned to engage the cam surface 40 of the pivot assembly 12.

Figure 6:
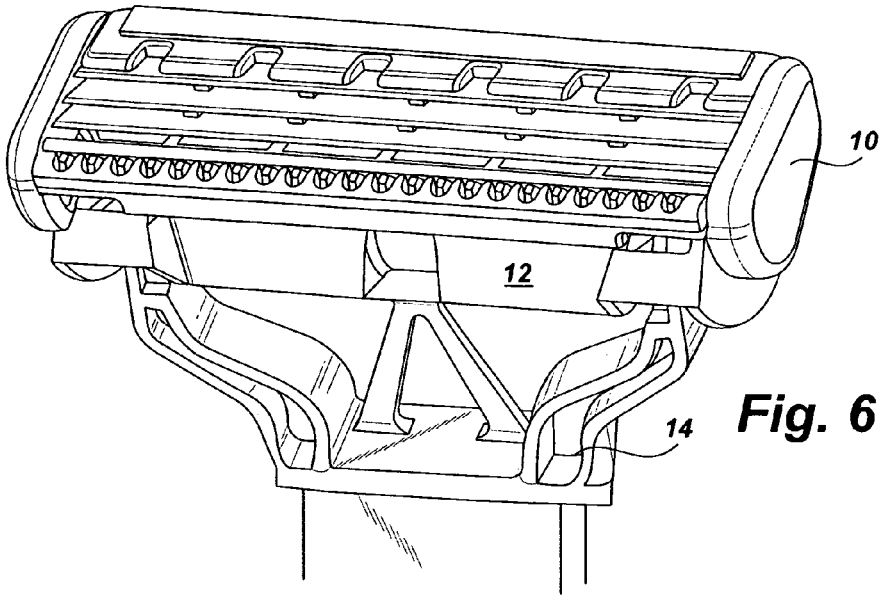
FIG. 6 is a front perspective view of the exemplary cartridge and pivot of FIGS. 1–3 mounted on the exemplary bi-directional pivot frame shown in FIG. 4, to form a bi-directional shaving system of the type contemplated by the invention.
Figure 7:
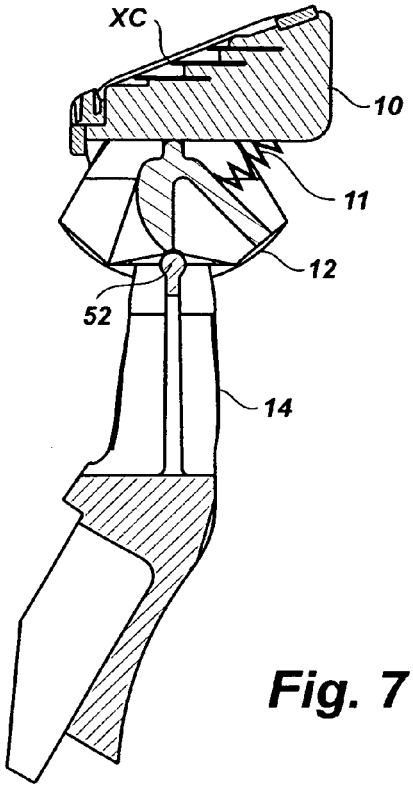
FIG. 7 illustrates a side sectional view of the shaving system of FIG. 6 with the blade assembly biased to the first position.
Figure 8:
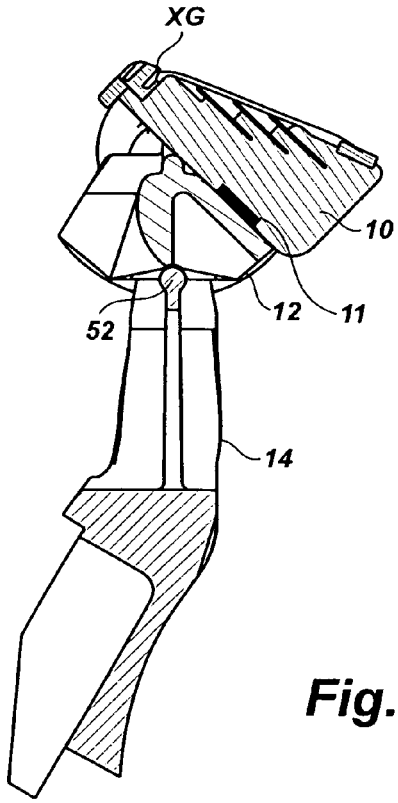
FIG. 8 illustrates a side sectional view of the shaving system of FIG. 6 with the blade assembly under loading pivoted to the second position.

FIGS. 6–8 illustrate the first embodiment assembled. As seen best in FIG. 7, a biasing spring 11 is located between the blade assembly 10 and the pivot assembly 12. The spring 11 biases the blade assembly to the position shown in FIG. 7. As seen in FIG. 7, when the blade assembly is in this first position, application of loading to the blade assembly will cause the blade assembly 10 and the pivot assembly 12 to pivot about the center line "C" of the blade assembly. Upon the application of additional load sufficient to overcome the reactive force exerted by the spring 11, the blade assembly 10 will be moved against the spring 11 and will move to a second position relative to the pivot assembly 12. FIG. 8 illustrates the second position. When the blade assembly is in the second position, application of loading to the blade assembly will cause the blade assembly and the pivot assembly to pivot about the guard-bar axis "G". From the foregoing, those skilled in the art will appreciate that the pivot assembly 12 illustrated in FIGS. 6–8 is free to pivot relative to the pivot frame approximately ±20° from the position shown in FIG. 7. Further, it will be appreciated that the blade assembly is free to pivot relative to the pivot assembly approximately 45° from the first position shown in FIG. 7 to the second position shown in FIG. 8.

Figure 9:
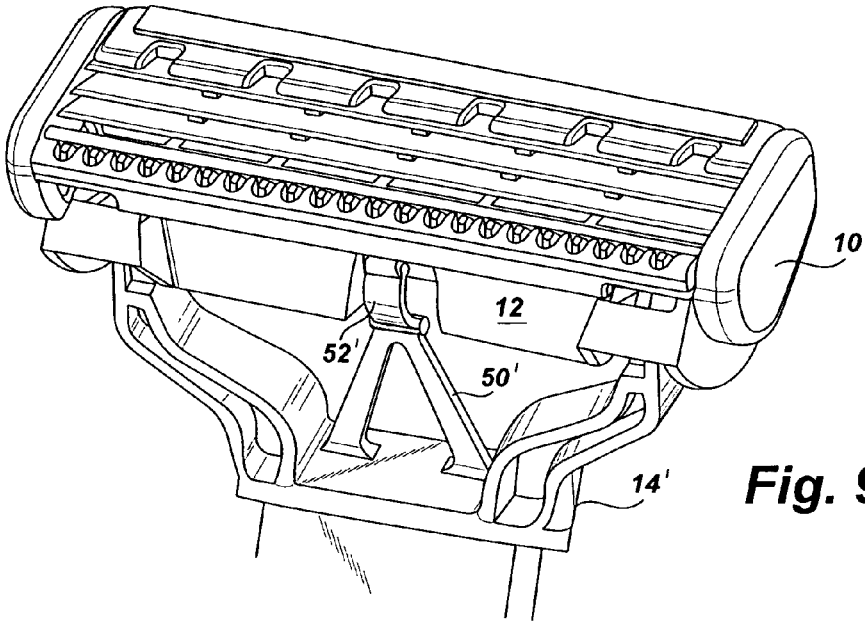
FIGS. 9–11 are similar to FIGS. 6–8 but illustrate the unidirectional embodiment.
Figure 10:
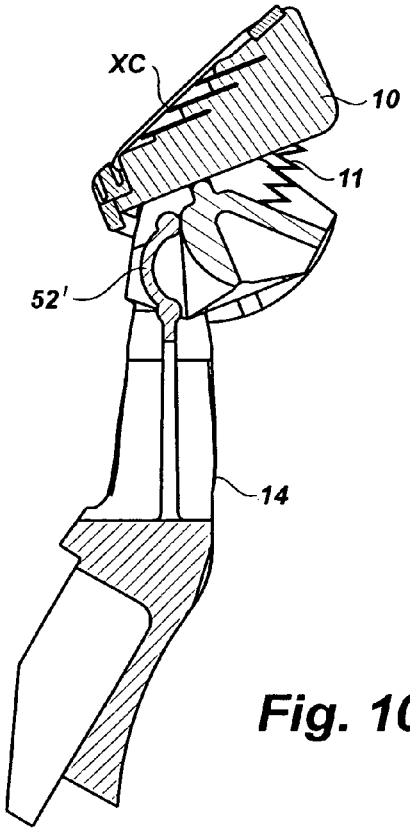
Figure 11:
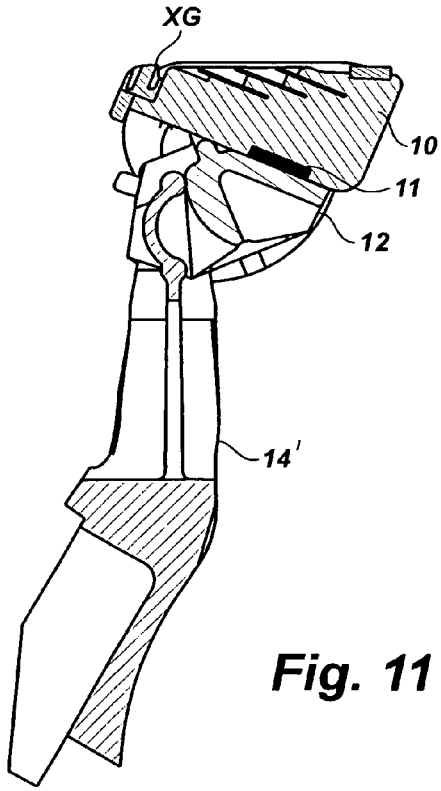

FIGS. 9–11 are similar to FIGS. 6–8 but illustrate a second embodiment of the invention utilizing the pivot frame 14'. Those skilled in the art will appreciate that the pivot assembly 12 illustrated in FIGS. 9–11 is free to pivot relative to the pivot frame approximately 40° from the center position to the position shown in FIGS. 10 and 11. Further, it will be appreciated that the blade assembly is free to pivot relative to the pivot assembly approximately 45° from the position shown in FIG. 10 to the position shown in FIG. 11.

As described above, the invention increases safety by shifting the pivot point from a center point pivot (i.e., at the center blade on the shave plane), to a guard-bar pivot on the shave plane as shaving forces increase. The cartridge pivots relative to the pivot assembly shifting from a center pivot to a guard-bar pivot. It is returned to its initial position by the spring between the cartridge or blade assembly and the pivot assembly. The blade assembly and pivot assembly also move as a unit relative to the pivot frame.

Those skilled in the art will appreciate that the pivot frame 14, 14' could be an integral part of the handle of a razor or could snap into the handle of a razor. It will be appreciated that the frame translates loads from the shavers hand to the cartridge (at either mid-blade or guard-bar positions) via the above-described pivoting motion.

Further considering the illustrated shaving system or razor assembly and its operation, the pivot frame 14, essentially comprises an extension of the razor handle (not shown), and cooperates with the pivot assembly 12 to form a shell bearing which supports the pivot assembly 12 for arcuate rocking movement on and relative to the pivot frame 14 about a virtual axis or system pivot axis located above both the pivot frame and the pivot assembly. This virtual axis, which comprises the pivot axis of the shaving system is substantially fixed relative to the pivot frame 14 and the razor handle (not shown). The system's pivot axis is shown in FIG. 7 and indicated by the letter X.

The blade assembly 10, which includes the three blades 20, 22 and 24, the cap 16, and the guard bar 18, is supported for limited pivotal movement about a fixed axis on the pivot assembly 12, the latter axis being defined by cooperation of the outwardly projecting semi-cylindrical bosses 32 and 34 carried by the pivot assembly 12 and received in the inwardly open sockets 26 formed in the blade assembly 10. Thus, the blade assembly 10 is supported for pivotal movement on the pivot assembly 12 about a fixed axis and through an angle of 45 degrees between the stop surfaces 28 and 30 on the sockets 26 and coengagable abutment surfaces on the bosses 32 and 34 between a first position of the blade assembly relatively to the pivot assembly, shown in FIG. 7, and a second position of the blade assembly relative to the pivot assembly, shown in FIG. 8. A biasing spring 11, which comprises the first biasing means, acts between the pivot assembly 12 and the blade assembly 10 to urge the blade assembly 10 toward and to its first position of FIG. 7.

The resilient cantilevered spring member 50 carried by the frame assembly 14 acts between the frame assembly 14 and the pivot assembly 12 to retain various moveable parts of the razor in a static or rest position when the razor is not in use and also allows 20 degree pivotal movement of the razor assembly 10 in either direction of rotation from the rest position and about the axis C, the degree of movement being controlled by the aforementioned shell bearings which couple the pivot assembly to the pivot frame.

It should be noted that when the blade assembly 10 is in its first position (FIG. 7) the virtual or system axis X is located substantially within the shaving plane and coincident with the leading edge of the center blade 22 in the blade group 20–24. Light shaving force applied to the blade assembly 10 may cause pivotal movement of the blade assembly 10 in either direction of rotational movement about the system pivot axis X in response to changes in skin surface contour and skin surface irregularities encountered during a normal shaving stroke. Since the spring 11 is responsive to a greater applied shaving force than the cantilevered biasing member 50, the blade assembly 10 will remain in its first position while the applied shaving forces are light. However, upon application of a heavier shaving force, that is a force of sufficient magnitude to overcome the reactive force exerted by the biasing spring 11, the blade assembly 10 will commence moving in a clockwise direction from its first position of FIG. 7 toward and ultimately to its second position (FIG. 8) causing the leading edge of the center blade 22 to move out of coaxial alignment with the system pivot axis X and further causing the guard bar 18 to take a position coincident with the system pivot axis, the latter position of the guard bar being indicated at G in FIG. 8. Thus, the shaving system of the present invention is sensitive to applied shaving force and is adapted to automatically shift the blade assembly from a center blade pivot position to a guard bar pivot position to accommodate changes in the magnitude of applied shaving force during the normal shaving process.

There have been described and illustrated herein several embodiments of an improved safety razor. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A shaving system comprising;

a blade assembly;

a pivot assembly supporting said blade assembly for pivotal movement between first and second positions; and a pivot frame supporting said pivot assembly for pivotal movement about a virtual pivot axis substantially coincident with one part of said blade assembly when said blade assembly is in said first position and substantially coincident with another part of said blade assembly when said blade assembly is in said second position, said blade assembly and said pivot assembly being pivotally movable about said virtual pivot axis in response to shaving force applied to said blade assembly.

2. A shaving system as set forth in claim 1 including first biasing means acting between said pivot assembly and said blade assembly for urging said blade assembly toward and to said first position.

3. A shaving system as set forth in claim 1 including second biasing means acting between said pivot frame and said pivot assembly for maintaining said blade assembly in a rest position when said shaving system is not in use and acting in opposition to movement of said blade assembly in at least one direction in response to a shaving force applied to said blade assembly during a shaving process.

4. A shaving system as set forth in claim 2 including second biasing means for maintaining said blade assembly in a rest position and yieldably resisting pivotal movement of said blade assembly in at least one direction of movement from said rest position in response to shaving force applied to said blade assembly.

5. A shaving system, comprising:

a) a pivot frame;

b) a pivot assembly coupled to said pivot frame for pivotal movement relative to said pivot frame about a system axis spaced from said pivot frame and said pivot assembly;

c) a blade assembly coupled to said pivot assembly for pivotal movement between first and second positions relative to said pivot assembly, said system axis being generally coaxially aligned with one part of said blade assembly when said blade assembly is in its first position and generally coaxially aligned with another part of said blade assembly when said blade assembly is in said second position;

d) first biasing means acting between said blade assembly and said pivot assembly for urging said blade assembly toward and to said first position; and e) second biasing means acting between said pivot assembly and said pivot frame for resisting pivotal movement of said pivot assembly and said blade assembly in at least one direction of rotation about said system axis.

6. A shaving system according to claim 5, wherein said first biasing means presents a greater resistance to movement in response to an applied shaving force than said second biasing means.

7. A shaving system according to claim 5, wherein said second biasing means allows pivotal movement of said pivot assembly in either direction of rotation from a rest position relative to said pivot frame.

8. A shaving system according to claim 5, wherein said second biasing means allows pivotal movement of said pivot assembly in only one direction of rotation from a rest position relative to said pivot frame.

9. A shaving system according to claim 5, wherein said second biasing means comprises a cantilevered spring member.

10. A shaving system according to claim 5, wherein said second biasing means includes a cam follower.

11. A shaving system according to claim 5, wherein said blade assembly is pivotally movable through an angle of approximately 45° relative to said pivot assembly.

12. A shaving system according to claim 11, wherein said pivot assembly is pivotally movable through an angle of approximately ±20° relative to said pivot frame.

13. A shaving system according to claim 11, wherein said pivot assembly is pivotally movable through an angle of approximately 40° relative to said pivot frame.

14. A triple blade shaving system, comprising:

a) a pivot frame;

b) a pivot assembly coupled to said pivot frame;

c) a blade assembly coupled to said pivot assembly;

d) first biasing means between said blade assembly and said pivot assembly; and e) second biasing means between said pivot assembly and said pivot frame, wherein said blade assembly includes a guard-bar, three blades, defines a shave plane and pivots relative to said pivot assembly between a first position and a second position; and (1) when in said first position pivotal movement of said pivot assembly relative to said pivot frame in response to shaving force applied to said blade assembly causes pivotal movement of said blade assembly about a center axis of said blades, substantially on said shave plane; and (2) when in said second position, pivotal movement of said pivot assembly relative to said pivot frame in response to shaving force applied to said blade assembly causes pivotal movement of said blade assembly substantially on said shave plane and about a guard-bar axis of said blade assembly.

15. A shaving system comprising a pivot assembly;

a pivot frame supporting said pivot assembly for limited pivotal movement about a virtual axis spaced from said pivot frame and said pivot assembly;

a blade assembly having a guard-bar, a blade group including a plurality of blades, and defining a shave plane, said blade assembly being supported on said pivot assembly for pivotal movement between first and second positions relative to said pivot assembly, said blade assembly having one part thereof coaxially aligned with said virtual axis when said blade assembly is in said first position and another part thereof coaxially aligned with said virtual axis when said blade assembly is in said second position.

16. A shaving system as set forth in claim 15 wherein said one part comprises a center part of said blade group.

17. A shaving system as set forth in claim 15 wherein said another part comprises said guard-bar.

18. A shaving system as set forth in claim 15 wherein said one part and said virtual axis are substantially disposed within said shave plane when said blade assembly is in said first position and said second position.

19. A shaving system as set forth in claim 15 including first biasing means for urging said blade assembly toward and to said first position.

20. A shaving system as set forth in claim 19 for maintaining said pivot assembly in a rest position when said system is not in use and yieldably resisting rotational movement of said pivot assembly in at least one direction of rotation about said virtual axis in response to shaving force applied to said blade assembly.

* * * * *